US009499239B2

(12) United States Patent
Davis et al.

(10) Patent No.: US 9,499,239 B2
(45) Date of Patent: Nov. 22, 2016

(54) INTEGRATED HEAVY LIFT AND LOGISTICS VESSEL

(71) Applicant: Keppel Offshore & Marine Technology Centre Pte. Ltd., Singapore (SG)

(72) Inventors: James Davis, Houston, TX (US); Peter George Noble, Katy, TX (US);
(Continued)

(73) Assignee: Keppel Offshore & Marine Technology Centre Pte. Ltd., Singapore (SG)

( * ) Notice: Subject to any disclaimer, the term of this patent is extended or adjusted under 35 U.S.C. 154(b) by 0 days.

(21) Appl. No.: 14/771,453

(22) PCT Filed: Feb. 28, 2014

(86) PCT No.: PCT/SG2014/000093
§ 371 (c)(1),
(2) Date: Aug. 28, 2015

(87) PCT Pub. No.: WO2014/133463
PCT Pub. Date: Sep. 4, 2014

(65) Prior Publication Data

US 2016/0016642 A1 Jan. 21, 2016

Related U.S. Application Data

(60) Provisional application No. 61/770,521, filed on Feb. 28, 2013.

(51) Int. Cl.
*B63B 29/00* (2006.01)
*B63B 35/42* (2006.01)
(Continued)

(52) U.S. Cl.
CPC ..... *B63B 35/42* (2013.01); *B63B 13/02* (2013.01); *B63B 27/00* (2013.01); *B63B 29/00* (2013.01);
(Continued)

(58) Field of Classification Search
CPC ..... B63B 13/02; B63B 13/00; B63B 35/42; B63B 25/006
See application file for complete search history.

(56) References Cited

U.S. PATENT DOCUMENTS 3,823,681 A * 7/1974 Cushing ..... B63B 25/006 114/260
3,934,530 A * 1/1976 Kossa ..... B63B 25/006 114/260
(Continued)

FOREIGN PATENT DOCUMENTS

GB 2405170 A 2/2005
NL 2005054 C 1/2012
(Continued)

OTHER PUBLICATIONS

International Preliminary Report on Patentability for International Application No. PCT/SG2014/000093, Report issued Sep. 1, 2015, Mailed Sep. 1, 2015, 6 Pgs.
(Continued)

*Primary Examiner* — Edwin Swinehart
(74) *Attorney, Agent, or Firm* — KPPB LLP

(57) ABSTRACT

This invention relates to an integrated heavy lift and logistics vessel for receiving another vessel. Further the integrated heavy lift and logistics vessel is able to provide logistical support to the other vessel in remote locations. More particularly, this invention relates to an integrated heavy lift and logistics vessel that is designed to carry out heavy lifting and logistic supply functions in a stable man-
(Continued)

ner. The integrated heavy lift and logistics vessel is also equipped with safe refuge quarters, helipad(s), various forms of storage, and areas for storage.

8 Claims, 9 Drawing Sheets

(72) Inventors: TakOn Cheung, Sugar Land, TX (US); Aziz Amirali Merchant, Singapore (SG); Sreekala Kumar, Singapore (SG); Abul Bashar Md Masum Reza, Singapore (SG)

(51) Int. Cl.

| | |
|---|---|
| ***B63B 13/02*** | (2006.01) |
| ***B63B 35/00*** | (2006.01) |
| ***B63B 27/00*** | (2006.01) |
| ***B63B 35/50*** | (2006.01) |
| *B63B 39/03* | (2006.01) |

(52) U.S. Cl.
CPC ..... *B63B 35/003* (2013.01); *B63B 35/50* (2013.01); *B63B 39/03* (2013.01)

(56) References Cited

U.S. PATENT DOCUMENTS 6,966,106 B1 * 11/2005 Roodenburg ..... E21B 19/14 166/75.11
2011/0180266 A1 * 7/2011 Elmbo ..... B63B 35/03 166/353

FOREIGN PATENT DOCUMENTS

WO 0027692 A1 5/2000
WO 0164507 A1 9/2001

OTHER PUBLICATIONS

International Search Report and Written Opinion for International Application No. PCT/SG2014/000093, Search completed May 22, 2014, Mailed Jun. 4, 2014, 10 Pgs.

* cited by examiner

INTEGRATED HEAVY LIFT AND LOGISTICS VESSEL

CROSS REFERENCE TO RELATED APPLICATIONS

This application is a national stage filing of PCT Patent Application Serial No. PCT/SG2014/000093 filed Feb. 28, 2014, which application claims priority to U.S. Provisional Application Ser. No. 61/770,521 filed Feb. 28, 2013, the disclosures of which are hereby incorporated by reference in their entireties.

FIELD OF THE INVENTION

This invention relates to an integrated heavy lift and logistics vessel for dry docking, deploying or logistically supporting another vessel in remote locations. More particularly, this invention relates to an integrated heavy lift and logistics vessel that is designed to carry out heavy lifting and transporting functions in a stable manner. The integrated heavy lift and logistics vessel is also equipped with an accommodation unit and various forms of storage.

PRIOR ART

In order to carry out exploration drilling in remote parts of the world such as the Arctic, it will be necessary to bring drilling units long distances and to provide proper logistics support for drilling programs in areas where little or no shore-side infrastructure exists. Others have attempted to address this problem by having separate heavy lift ships transport drilling units to the general vicinity required but generally not directly to the drill-site. Heavy lift ships are expensive and in high demand so it is not possible to dedicate such a unit to assist in transporting and/or supporting drilling units. In the past, ware barges have been used to support remote offshore drilling programs but these have been done with temporary arrangements and have not proved overly efficient.

SUMMARY OF INVENTION

The above and other problems are solved and an advance in the art is made by an integrated heavy lift and logistics vessel provided by embodiments in accordance with this invention. A first advantage of embodiments of an integrated heavy lift and logistics vessel in accordance with this invention is that the integrated heavy lift and logistics vessel is able to receive, load and dock another vessel onto a deck of the integrated heavy lift and logistics vessel by controlling a ballasting system of the integrated heavy lift and logistics vessel. As the ballasting system lowers the integrated heavy lift and logistics vessel below a water level, an accommodation unit provided on a top surface of a deck box remains dry throughout the ballasting operations. Further, as the integrated heavy lift and logistics vessel is submerging, a section of the semi-enclosed forecastle structure at the forward end of the main deck will freely flood thereby reducing the above-deck buoyancy of the integrated heavy lift and logistics vessel. This unique feature is not found in other vessels. A second advantage of embodiments of an integrated heavy lift and logistics vessel in accordance with this invention is that a section of the semi-enclosed forecastle structure may be flooded through the use of a tube that is provided either at the first wing-wall, the second wing-wall or at both the first and second wing-walls. The flooding of this section of the semi-enclosed forecastle structure assists in reducing the above deck buoyancy of the submerging vessel making it easier for the vessel to submerge.

The above and other problems in the art are solved and an advance in the art is made in accordance with this invention. In accordance with a first aspect of the invention, there is provided an integrated heavy lift and logistics vessel having a deck with a first section for receiving a vessel, and a second section that is bordered by a first wing-wall provided on a port side of the deck, a second wing-wall provided on a starboard side of the deck, and a deck box provided at a bow of the deck whereby the deck box abuts the first wing-wall and the second wing-wall. The integrated heavy lift and logistics vessel also has a ballasting system that is configured to lower the deck below a water level and below a hull of a docking vessel, and to raise the deck above the water level, wherein the second section of the deck is configured to flood when the deck is lowered below the water level thereby reducing the above-deck buoyancy of the heavy lift and logistics vessel. Further, an accommodation unit is also provided on the top surface of the deck box.

In accordance with embodiments of the invention, the first wing-wall of the integrated heavy lift and logistics vessel comprises a first tube that extends from a hull of the integrated heavy lift and logistics vessel to the deck. The first tube has a first opening at the hull and a second opening at a surface of the deck. When the ballasting system lowers the deck below the water level, this will cause water to flow through the first tube via the first opening and the second opening to flood the second section of the deck. In accordance with embodiments of the invention, this first tube may be tilted at an angle in relation to a surface of the deck such that the first opening of the tube is positioned lower than the second opening of the first tube.

In accordance with embodiments of the invention, the second wing-wall of the integrated heavy lift and logistics vessel also comprises a second tube that extends from a hull of the integrated heavy lift and logistics vessel to the deck. The second tube has a first opening at the hull and a second opening at a surface of the deck. When the ballasting system lowers the deck below the water level, this will cause water to flow through the second tube via the first opening and the second opening to flood the second section of the deck.

In accordance with embodiments of the invention, the integrated heavy lift and logistics vessel further includes a helipad that is provided on a top surface of the accommodation unit. Means for handling discharge of cargo from the integrated heavy lift and logistics vessel to an attending vessel may also be provided on the integrated heavy lift and logistics vessel in embodiments of the invention.

In accordance with embodiments of the invention, the integrated heavy lift and logistics vessel includes an emergency shelter. The emergency shelter may include emergency medical facilities as well.

In accordance with embodiments of the invention, storage means are provided in a hull of the integrated heavy lift and logistics vessel for storing liquids, including provision for carry liquids on deck in flexible bladders.

In accordance with embodiments of the invention, the integrated heavy lift and logistics vessel has an anchor winch that is provided on the top surface of the deck box for guiding the other vessel to the deck.

In accordance with embodiments of the invention, pipe racks are provided on the top surface of the deck box of the heavy lift and logistics vessel for storing tubular members.

BRIEF DESCRIPTION OF THE DRAWINGS

The above advantages and features of a system in accordance with this invention are described in the following detailed description and are shown in the drawings.

DETAILED DESCRIPTION

Figure 1:
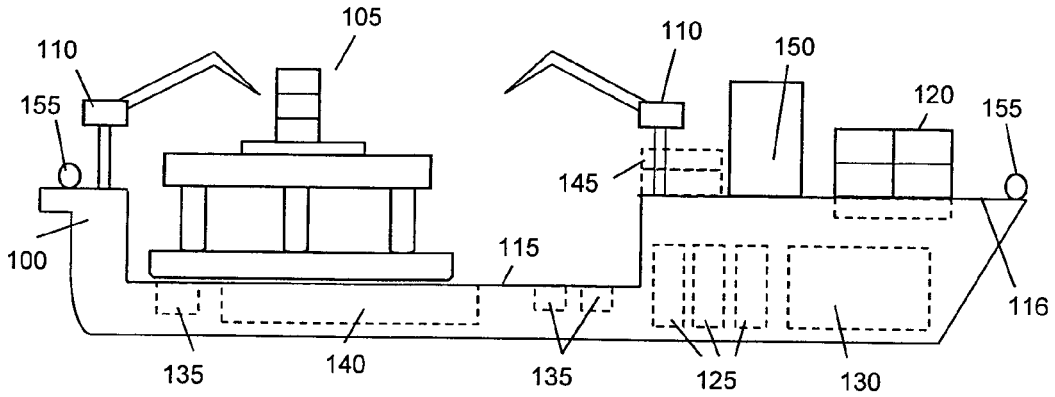
FIG. 1 illustrating a side view of an integrated heavy lift and logistics vessel with a docked vessel in accordance with embodiments of this invention.

This invention relates to an integrated heavy lift and logistics vessel for dry docking, deploying or logistically supporting another vessel in remote locations. More particularly, this invention relates to an integrated heavy lift and logistics vessel that is designed to carry out heavy lifting and transporting functions. The integrated heavy lift and logistics vessel is also equipped with an accommodation unit and various forms of storage. The integrated heavy lift and logistics vessel may also be used to transport heavy, large and bulky cargo or vessels from one port to another or from one location to another. Cargo or vessels that may be transported by the integrated heavy lift and logistics vessel may include, but are not limited to, drilling units, drilling platforms, jack-up units. Although the subsequent description only describes the loading and transportation of vessels, one skilled in the art will recognize that the integrated heavy lift and logistics vessel may also be used to transport other types of floatable bulky cargo without departing from this invention.

The integrated heavy lift and logistics vessel in accordance with embodiments of the invention provides means of combining transportation and logistical support which allows for efficient operations as opposed to existing methodologies where these functions are carried out separately and are conducted in an ad hoc manner rather than in an integrated fashion as made possible by this invention. This invention has primary application in waters suitable for drilling using a self-elevation drilling unit (jack-up), offshore Alaska, Canada, and Russia in its Arctic embodiment and in areas such as Central America, West Africa and South East Asia.

An integrated heavy lift and logistics vessel in accordance with embodiments of the invention is able to dry dock another vessel by controlling a ballasting system of the integrated heavy lift and logistics vessel. As the ballasting system lowers the integrated heavy lift and logistics vessel below a water level, an accommodation unit provided on a top surface of a deck box remains dry throughout the ballasting operations. Further, as the integrated heavy lift and logistics vessel is submerging, a forward section of the semi-enclosed deck will freely flood thereby reducing the above-deck buoyancy of the integrated heavy lift and logistics vessel.

In accordance with embodiments of the invention, a wing-wall on the integrated heavy lift and logistics vessel may be provided with a flooding tube or a freeing port that is there to allow ingress and egress of water from the interior floodable forward section. As the ballasting system lowers the deck of the integrated heavy lift and logistics vessel below a water level, the forward section of the deck may be initially flooded through the use of this tube or port that may be provided either at the first wing-wall, the second wing-wall or at both the first and second wing-walls. The flooding of this semi-enclosed section assists in reducing the above deck buoyancy of the submerging vessel making it easier for the vessel to submerge. As the ballasting system raises the deck of the integrated heavy lift and logistics vessel above the water level, water pooled within the section of the deck may be released to sea through the use of these tubes thereby lightening the load on the integrated heavy lift and logistics vessel allowing this vessel to rise faster.

FIG. 1 illustrates a side view of a heavy lift and logistics vessel with a docked vessel in accordance with embodiments of the invention. Heavy lift and logistics vessel 100 comprises cranes 110, deck 115, deck box 116, pipe racks 120, storage areas 125, 130, 135, 140, winch 155, containers 145 and accommodation unit 150. Heavy lift and logistics vessel 100 also has a ballasting system comprising one or more ballast tanks installed (not shown) across a hull of heavy lift and logistics vessel 100. The structure of deck box 116 is such that an entire top surface of deck box 116 will remain above a water level throughout ballasting operations. In other words, the height or elevation of the top surface of deck box 116 is configured such, so that the top surface of deck box 116 will remain dry as heavy lift and logistics vessel 100 submerges and rises during ballasting operations. As accommodation unit 150 is provided on the top surface of deck box 116, this means that accommodation unit 150 will also remain dry throughout ballasting operations. As illustrated in FIG. 1, deck 115 is used for receiving a vessel that is to be dry-docked. In FIG. 1, it is illustrated that the dry docked vessel is vessel 105. Further, the width of deck 115 is designed to be wider than the width of vessel 105 so that vessel 105 may be floated above deck 115 safely without colliding into the hull of heavy lift and logistics vessel 100 or the sides of deck box 116.

In embodiments of the invention, an emergency shelter is provided within accommodation unit 150. In further embodiments, the emergency shelter is provided with emergency medical facilities. Accommodation unit 150 may also be used to house all the workers on heavy lift and logistics vessel 100. In extreme situations or in emergencies, accommodation unit 150 may also be used as a safe refuge quarters that can be set up to accommodate the operations unit that is being logistically supported. Such a setup would be useful in situations whereby workers/personnel from a nearby vessel/platform/dock would have to be evacuated and may seek temporary refuge while awaiting assistance or evacuation from other sources. Accommodation unit 150 will also be capable of handling the personnel from vessel 105 in temporary quarters located within accommodation unit 150 until further assistance can arrive to provide assistance. In addition to emergency medical facilities, the emergency shelter may include a galley/mess for personnel that it may accommodate. The heavy lift and logistics vessel may also be provided with additional small living quarters for personnel working on the heavy lift and logistics vessel in its normal operating mode.

Storage areas 125, 130, 135, and 140 may be used to store various items such as fluids, pipes and any other types of bulky items. One skilled in the art will recognize that the size and positioning of these storage areas may vary according to their requirements. Cranes 110 may be used to handle the discharge of cargo to and from heavy lift and logistics vessel 100 onto a nearby attending vessel or onto the docks. One skilled in the art will recognize that the positioning and number of cranes 110 may be altered or varied accordingly without departing from this invention.

When vessel 105 is to be docked onto heavy lift and logistics vessel 100, the ballast tanks on heavy lift and logistics vessel 100 will be flooded. As the ballast tanks are flooded, heavy lift and logistics vessel 100 will slowly submerge further below the water level. Under conventional operating conditions, as the ballast tanks are typically positioned at various parts across heavy lift and logistics vessel 100, the ballast tanks will be gradually filled in order to minimize the yaw and roll of heavy lift and logistics vessel 100 as heavy lift and logistics vessel 100 is being submerged. Once deck 115 has submerged sufficiently below the water level to receive vessel 105, vessel 105 will then be guided over deck 115 of heavy lift and logistics vessel 100. Once vessel 105 is in position over deck 115, the water within the ballast tanks will be gradually pumped out, until the tanks have been sufficiently emptied. As the tanks are being emptied, heavy lift and logistics vessel 100 will gradually rise from the water. The rising of heavy lift and logistics vessel 100 together with deck 115 will cause deck 115 to lift vessel 105 along, effectively dry docking vessel 105 onto heavy lift and logistics vessel 100. When this happens, a normally submerged section of vessel 105 will be raised above the water level. The entire process is reversed when vessel 105 is to be unloaded off heavy lift and logistics vessel 100. This float-on/float-off method allows for extremely heavy and vessels and/or bulky cargo to be easily manipulated on and off vessel 100. In addition to the float-on/float-off method described above, cargo may also be loaded on and unloaded off heavy lift and logistics vessel 100 using a roll-on/roll-off method by raising either the starboard side or port side of heavy lift and logistics vessel 100, allowing vessel 105 to be lowered off deck 115 onto a quayside.

Figure 2:
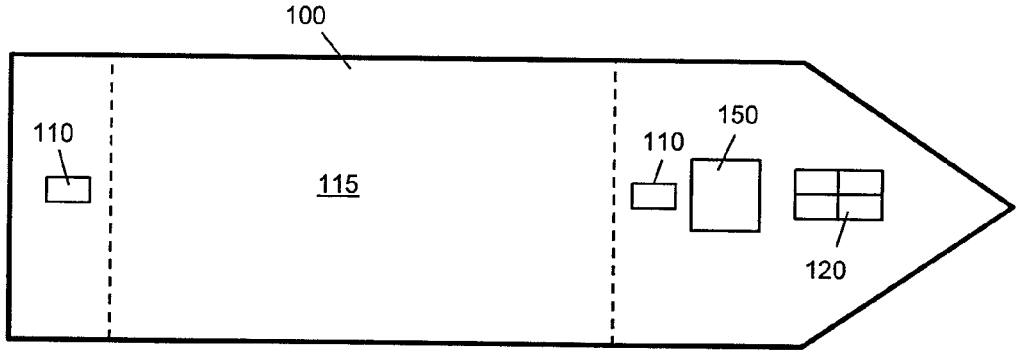
FIG. 2 illustrating a plan view of an integrated heavy lift and logistics vessel in accordance with embodiments of this invention.

A plan view of heavy lift and logistics vessel 100 is illustrated in FIG. 2. One skilled in the art will recognize that accommodation unit 150 may be placed at any position on deck box 116 without departing from the invention. Similarly, pipe racks 120 and cranes 110 may be placed at various positions on deck box 116 without departing from the invention. The width of deck 115 may vary according to the width of vessel 105 that is to be docked on deck 115.

Figure 3:
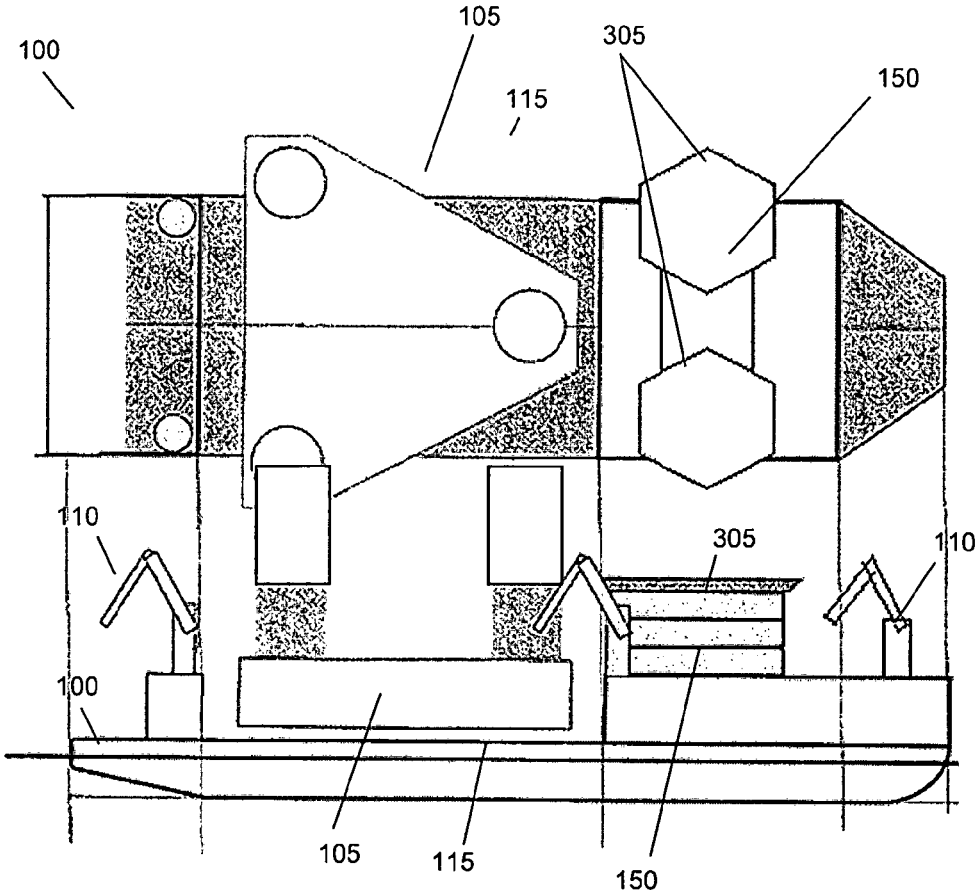
FIG. 3 illustrating a plan view and a side view of an integrated heavy lift and logistics vessel in accordance with embodiments of this invention.

FIG. 3 illustrates a plan view and a side view of heavy lift and logistics vessel 100 in accordance with embodiments of the invention. In this embodiment, helipads 305 are provided on a top surface of accommodation hub 150. Helipads 305 allow for helicopters from nearby vessels and/or docks to land on vessel 100 in case of emergencies. For example, if personnel aboard heavy lift and logistics vessel 100 or docked vessel 105 need to be evacuated, such personnel may do so via these helicopters.

Figure 4A:
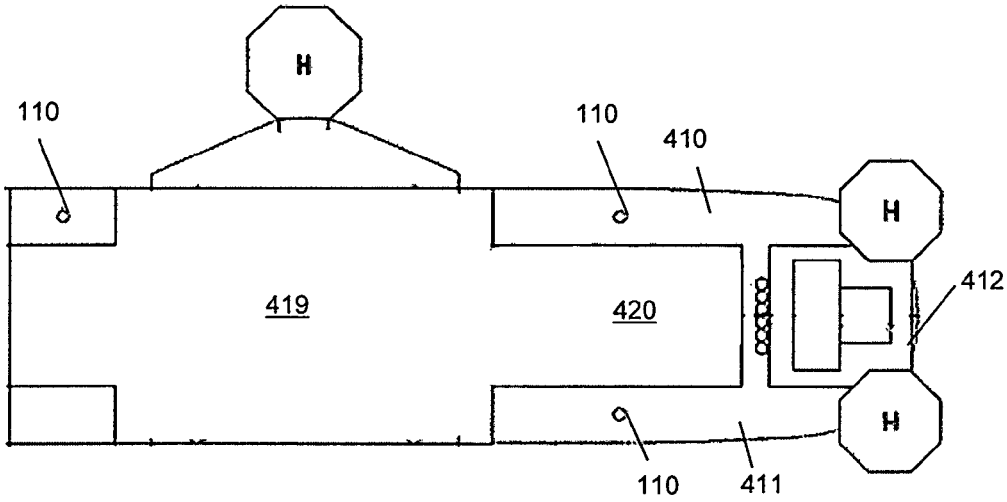
FIG. 4*a* illustrating a plan view of an integrated heavy lift and logistics vessel in accordance with embodiments of this invention.

In embodiments of the invention, as illustrated in FIG. 4*a*, integrated heavy lift and logistics vessel 100 has a deck that may be divided into two decking sections, which is decking section 419 and decking section 420. Decking section 419 is used for receiving and/or docking vessel 105 while decking section 420, which is bordered on a first side by wing-wall 410, on a second side by deck box 412 and on a third side by wing-wall 411, freely floods when integrated heavy lift and logistics vessel 100 submerges. As integrated heavy lift and logistics vessel 100 begins to submerge, water will flow onto the deck of integrated heavy lift and logistics vessel 100 through the sides of decking section 419. The flowing water will then collect and pool at decking section 420. The collecting of water or the flooding of section 420 causes the above-deck buoyancy of vessel 100 to reduce thereby allowing vessel 100 to submerge easily. Wing-walls 410, 411 and deck box 412 further assists in stabilizing integrated heavy lift and logistics vessel 100 when vessel 100 is submerged.

The long forecastle area within wing-walls 410, 411 provide a covered area that may be used as storage space for bulk materials. Further, this covered area may be utilized as a work area, protected from severe weather, for assembling parts or conducting on ship maintenance and repairs.

Figure 4B:
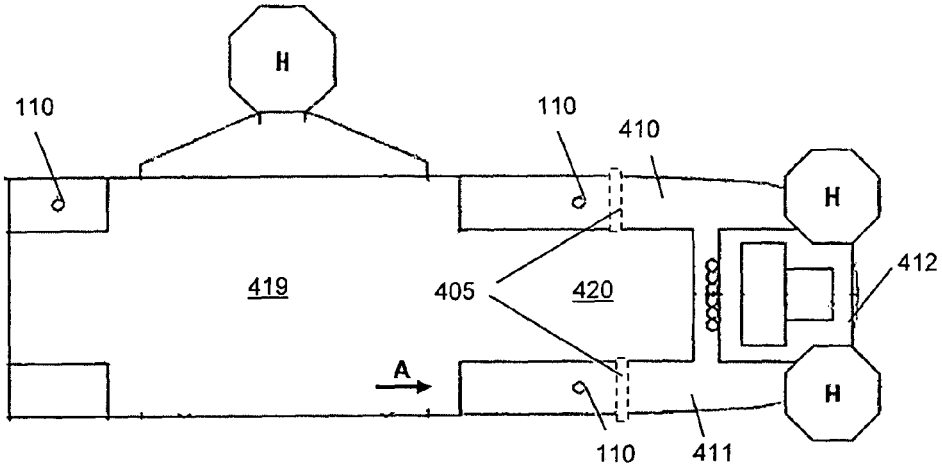
FIG. 4*b* illustrating a plan view of an integrated heavy lift and logistics vessel having flooding tubes or ports in accordance with embodiments of this invention.

In embodiments of the invention, a flooding tube may be provided within wing-walls 410 and/or 411 to accelerate the flooding of decking section 420. As illustrated in FIG. 4*b*, tube 405 may be provided within each of wing-walls 410 and 411 to allow water from the sea to flow to decking section 420 as vessel 100 begins submerging. Although FIG. 4*b* illustrates that tube 405 is provided within each of wing-walls 410 and 411, one skilled in the art will recognize that any number of tubes 405 may be used without departing from this invention. In other words, in an embodiment of the invention, only wing-wall 410 of vessel 100 may be provided with one of tube 405 while in another embodiment of the invention, it may be only wing-wall 411 of vessel 100 that is provided with one of tube 405.

As illustrated in FIG. 4*b*, tube 405 has an opening at the hull of vessel 100 or at the exterior walls of wing-walls 410, 411 that faces the sea, and another opening at the interior walls of wing-walls 410, 411 facing decking section 420. As the ballasting system of vessel 100 begins to submerge vessel 100, water from the sea will flow through tube 405 via the opening of tube 405 that faces the sea, which is the opening at the hull of vessel 100 or at the exterior walls of wing-walls 410, 411. The water will then flow out from tube 405 through the other opening located at the interior walls of wing-walls 410, 411 onto decking section 420. As water floods and ponds at decking section 420, this causes the above deck buoyancy of vessel 100 to greatly reduce thereby making it easier for vessel 100 to submerge.

After vessel 105 has been loaded and docked onto vessel 100, the ballasting system of vessel 100 will begin to raise the deck of vessel 100 above the water level. As vessel 100 rises, water contained within decking section 420 will flow out to sea via tube 405. The rapid emptying of water contained within decking section 420 allows for vessel 100 to rise faster and to achieve a stable floating state quicker.

Figure 4C:
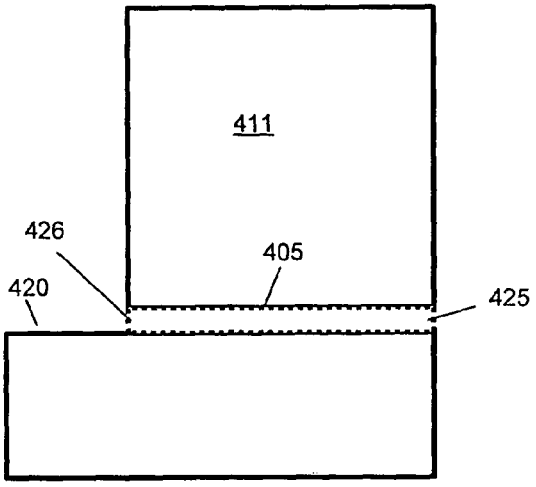
FIGS. 4*c* and 4*d* illustrating a cross sectional view of an integrated heavy lift and logistics vessel in accordance with the embodiment illustrated in FIG. 4*b* from the perspective of arrow A.

FIG. 4*c* illustrates a cross-sectional view of wing-wall 411 as seen from the angle of arrow A. As illustrated in FIG. 4*c*, tube 405 extends from a hull of integrated heavy lift and logistics vessel 100, through wing-wall 411, to section 420 of the deck. In other words, tube 405 has opening 426 that is located at the hull and opening 425 that is adjacent the surface of section 420 of the deck. When the ballasting system lowers the deck below the water level, this causes water to flow from opening 425, through tube 405, and out to section 420 of the deck via opening 425 thereby flooding this section of the deck. In contrast, as the ballasting system raises the deck above the water level, water pooled within section 420 will flow in the opposite direction through tube 405 that is the pooled water will flow through opening 426, through tube 405 and out to sea via opening 425.

Figure 4D:
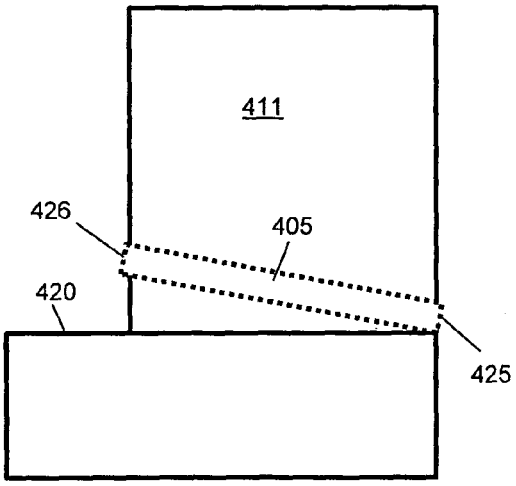

In accordance with embodiments of the invention, tube 405 may be tilted at an angle in relation to a surface of the deck such that the first opening of the tube is positioned lower than the second opening of the first tube. This will allow water pooled within section 420 to empty faster when the ballasting system raises the deck of vessel 100 above the water level. Such an embodiment is illustrated in FIG. 4*d*.

Figure 5:
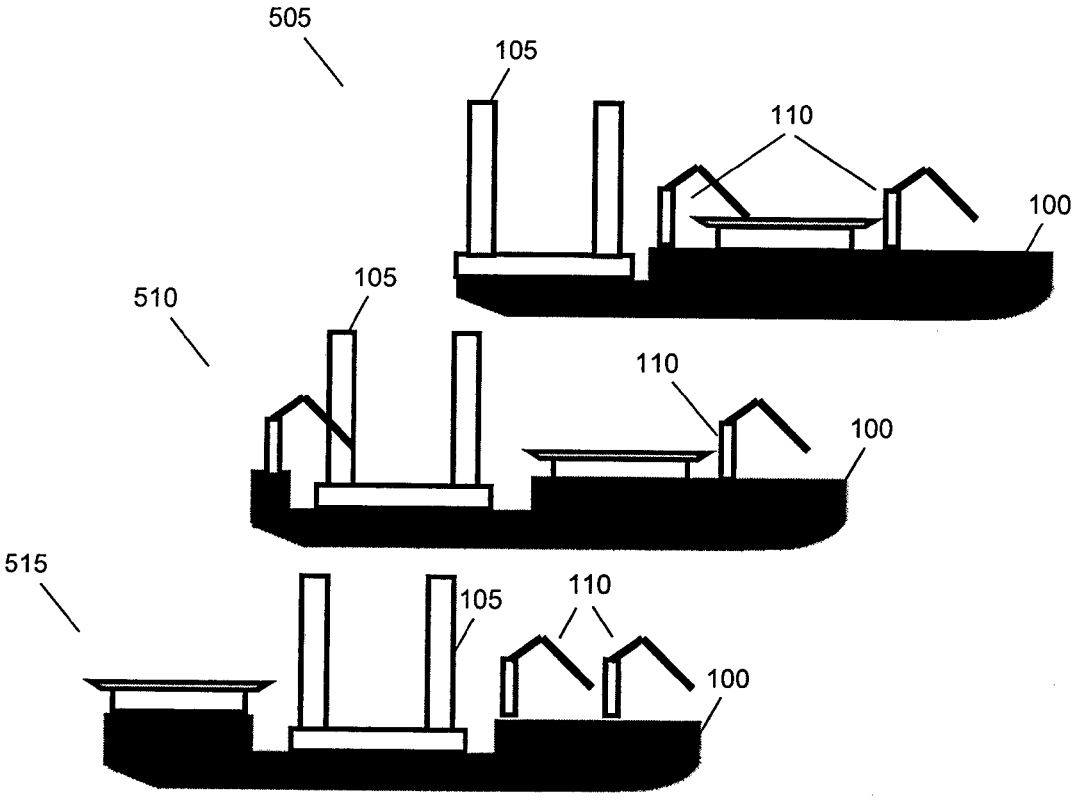
FIG. 5 illustrating side views of the integrated heavy lift and logistics vessel in accordance with embodiments of this invention.

In embodiments of the invention, deck 115 or decking section 419 may be provided either at the stern of heavy lift and logistics vessel 100, the aft of heavy lift and logistics vessel 100 or at the middle of heavy lift and logistics vessel 100. These embodiments are illustrated in FIG. 5. Embodiment 505 illustrates deck 115 or decking section 419 being positioned at the stern of heavy lift and logistics vessel 100 while embodiment 510 illustrates deck 115 or decking section 419 being positioned at the aft of heavy lift and logistics vessel 100 and embodiment 515 illustrates deck 115 or decking section 419 being positioned at the middle of heavy lift and logistics vessel 100.

Figure 6A:
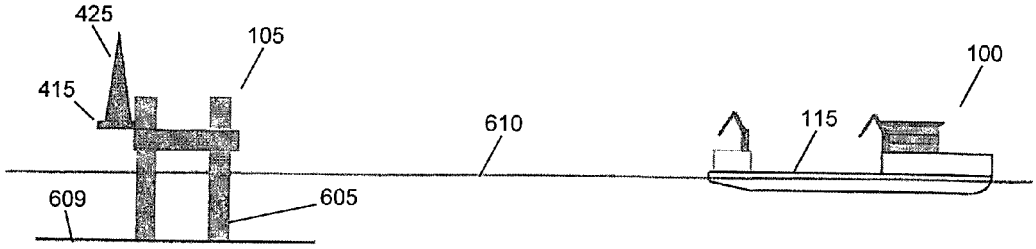
FIGS. 6*a*-6*k* illustrating a story board showing the operation of an integrated heavy lift and logistics vessel in accordance with embodiments of this invention.
Figure 6B:
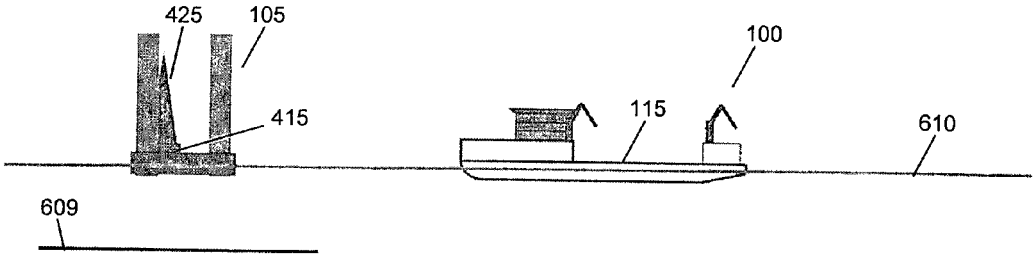
Figure 6C:
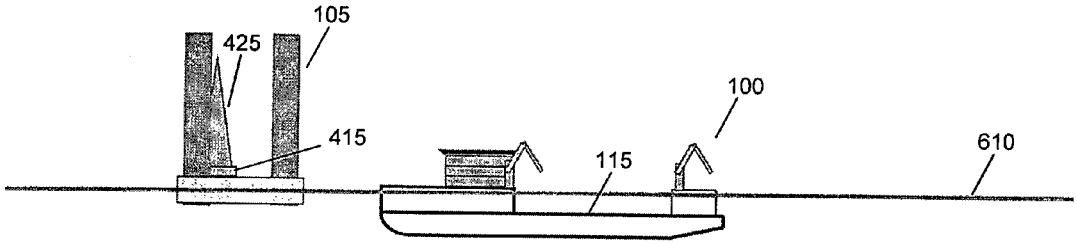
Figure 6D:
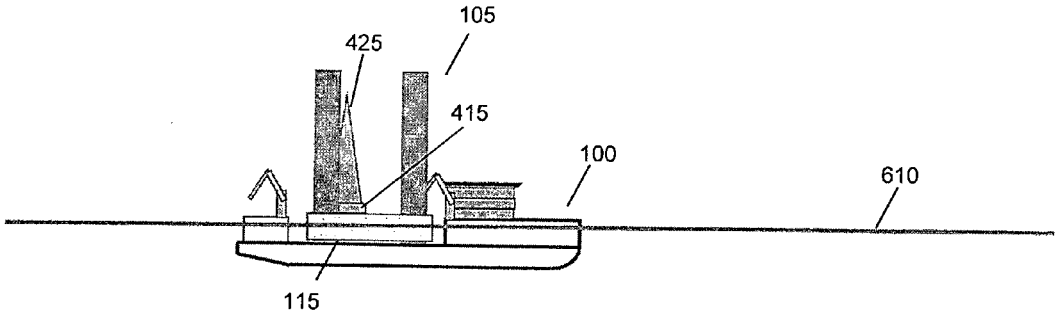
Figure 6E:
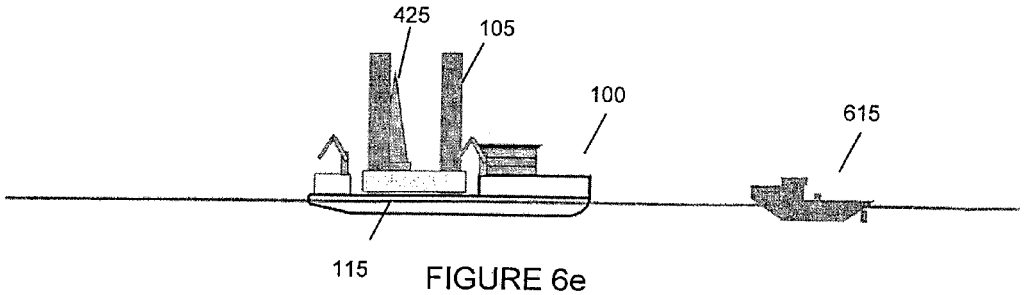
Figure 6F:
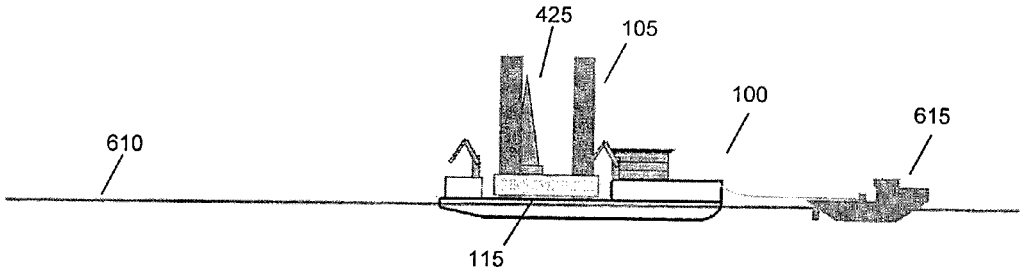
Figure 6G:
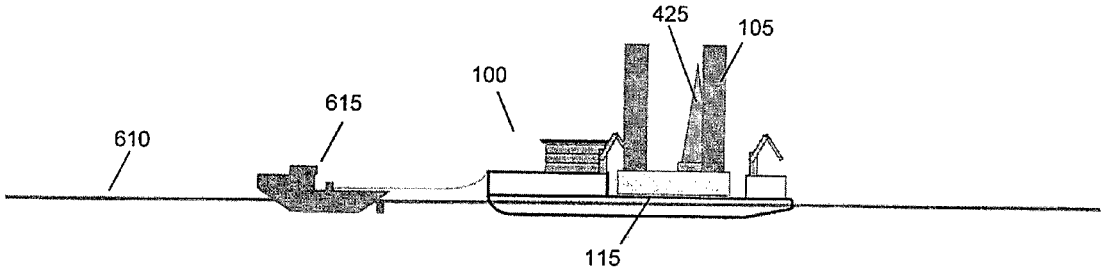
Figure 6H:
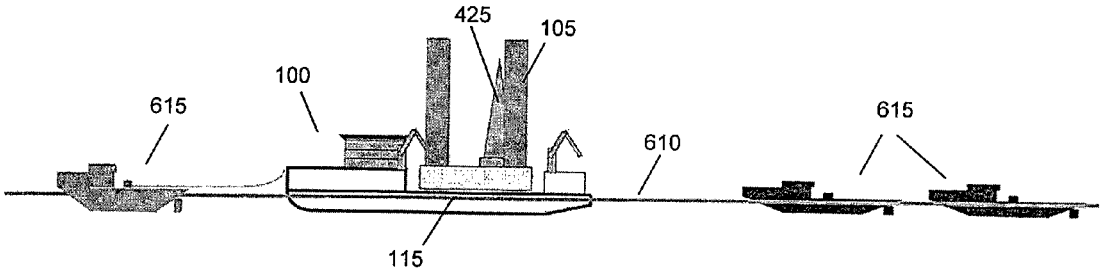

FIGS. 6*a*-6*k* illustrates the loading and docking of vessel 105 onto heavy lift and logistics vessel 100. For brevity, in FIGS. 5*a*-6*k*, although reference is only made to deck 115, one skilled in the art will recognize that decking section 419 may be used interchangeably with deck 115 without departing from the invention. FIG. 6*a* illustrates vessel 105 when vessel 105 is vertically moored to seabed 609 via tension leg moorings 605. When vessel 105 is moored, the upper portion of vessel 105 will remain above water level 610. After vessel 105 has completed its drilling operations, vessel 105 will jack up from seabed 609 and float freely as illustrated in FIG. 6*b*. When this happens, vessel 100 will move closer to vessel 105 in preparation for dry docking procedures. FIG. 6*c* illustrates heavy lift and logistics vessel 100 after the ballast tanks in heavy lift and logistics vessel 100 has been flooded causing vessel 100 to submerge below water level 610. The flooding of the ballasts in vessel 100 are controlled carefully to ensure that heavy lift and logistics vessel 100 does not submerge too deep, specifically to ensure that accommodation unit 150 does not submerge below water level 610. However, heavy lift and logistics vessel 100 must be sufficiently submerged so that deck 115 is lower than the hull of vessel 105. Vessel 105 is then guided over deck 115 either through self-propulsion, through the use of tug boats, or through the use of anchor winches 155 provided on heavy lift and logistics vessel 100. Once vessel 105 is positioned directly above deck 115 as illustrated in FIG. 6*d*, heavy lift and logistics vessel 100 will empty its ballast tanks causing heavy lift and logistics vessel 100 to rise above water level 610. As heavy lift and logistics vessel 100 rises, this causes deck 115 together with docked vessel 105 to rise as well. The transit of heavy lift and logistics vessel 100 to a new location is illustrated in FIGS. 6*e*, 6*f*, 6*g* and 6*h*. Once deck 115 and the normally submerged section of docked vessel 105 has been raised above water level 610; tug boat 615 will approach to assist in the transporting of heavy lift and logistics vessel 100 with docked vessel 105 to a new location. In embodiments of the invention, if heavy lift and logistics vessel 100 is provided with self-propulsion systems, it will not be necessary for tug boat 615 to assist heavy lift and logistics vessel 100 in moving to a new location as heavy lift and logistics vessel 100 will be able to do so by its own accord. The propulsion system may comprise of a self-propulsion system or a propulsion-assist system. One skilled in the art will recognize that other types of propulsion systems may be used without departing from this invention.

Figure 6I:
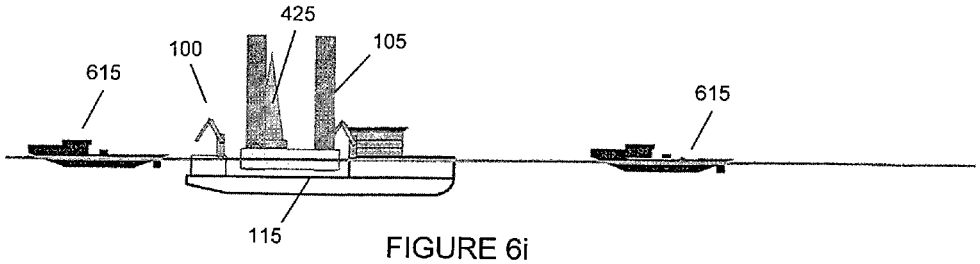
Figure 6J:
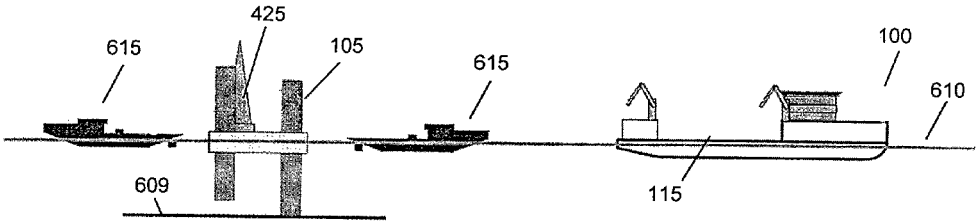
Figure 6K:
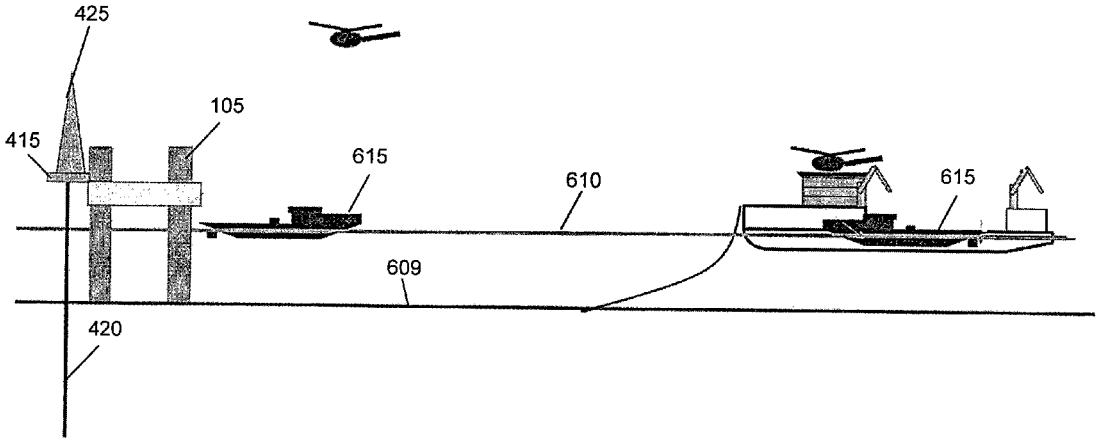

FIG. 6*i* illustrates that once heavy lift and logistics vessel 100 has reached its new location, the ballast tanks of heavy lift and logistics vessel 100 will be flooded causing deck 115 together with docked vessel 105 to submerge below water level 610. As tugboat 615 would have tied guide ropes around vessel 105 in anticipation of the float-off procedures, tugboat 615 may then guide vessel 105 away from heavy lift and logistics vessel 100 towards the new location. After heavy lift and logistics vessel 100 has safely undocked vessel 105 at its new location and after vessel 105 has been floated off deck 115, heavy lift and logistics vessel 100 may then moor nearby using various mooring arrangements such as spread mooring, bow anchor mooring or spud moorings. As heavy lift and logistics vessel 100 is provided with accommodation unit 150 and various storage arrangements, heavy lift and logistics vessel 100 may assist in the drilling procedures going on at vessel 105. Once vessel 105 arrives at the new location, vessel 105 will moor itself at its new location. In the embodiment shown in FIG. 6*j*, vessel 105 is vertically moored on seabed 609 using tension leg moorings thereby securing itself at its new location.

Figure 7:
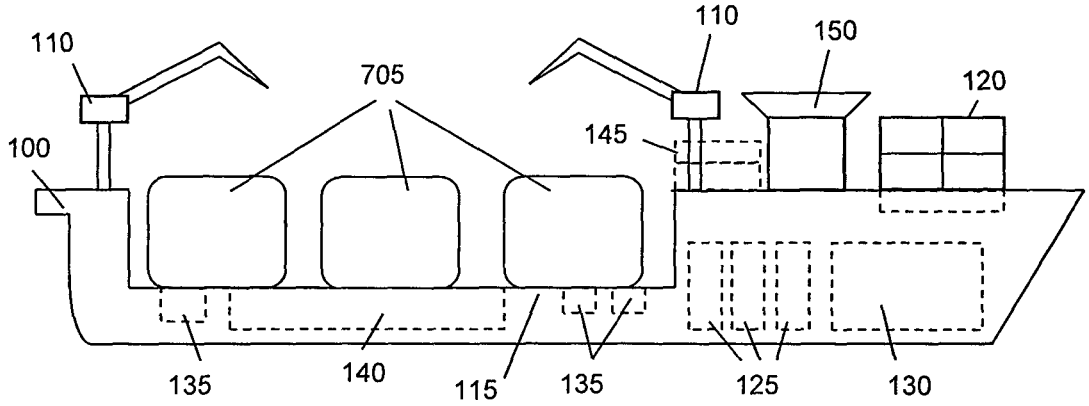
FIG. 7 illustrating a side view of an integrated heavy lift and logistics vessel in accordance with embodiments of this invention.

In embodiments of the invention, inflatable liquid storage bags or bladders 705 may be inflated, filled with fluid and placed on top of deck 115 as illustrated in FIG. 7. This provides additional fluid storage to support well drilling operations. Further, inflatable liquid storage bags 705 when deflated may be stored in any of storage areas 125, 130, 135 or 140.

Heavy lift and logistics vessel 100 combines the transport and logistics support functions along with duties such as emergency stand-by, helicopter operations support etc. Such features of heavy lift and logistics vessel 100 provide an effective solution to drilling in remote areas with seasonal requirements whereby drilling units are moved on a regular basis. An example of such remote areas is in the Arctic whereby rigs need to be removed in the heavy ice winter months.

Figure 8:
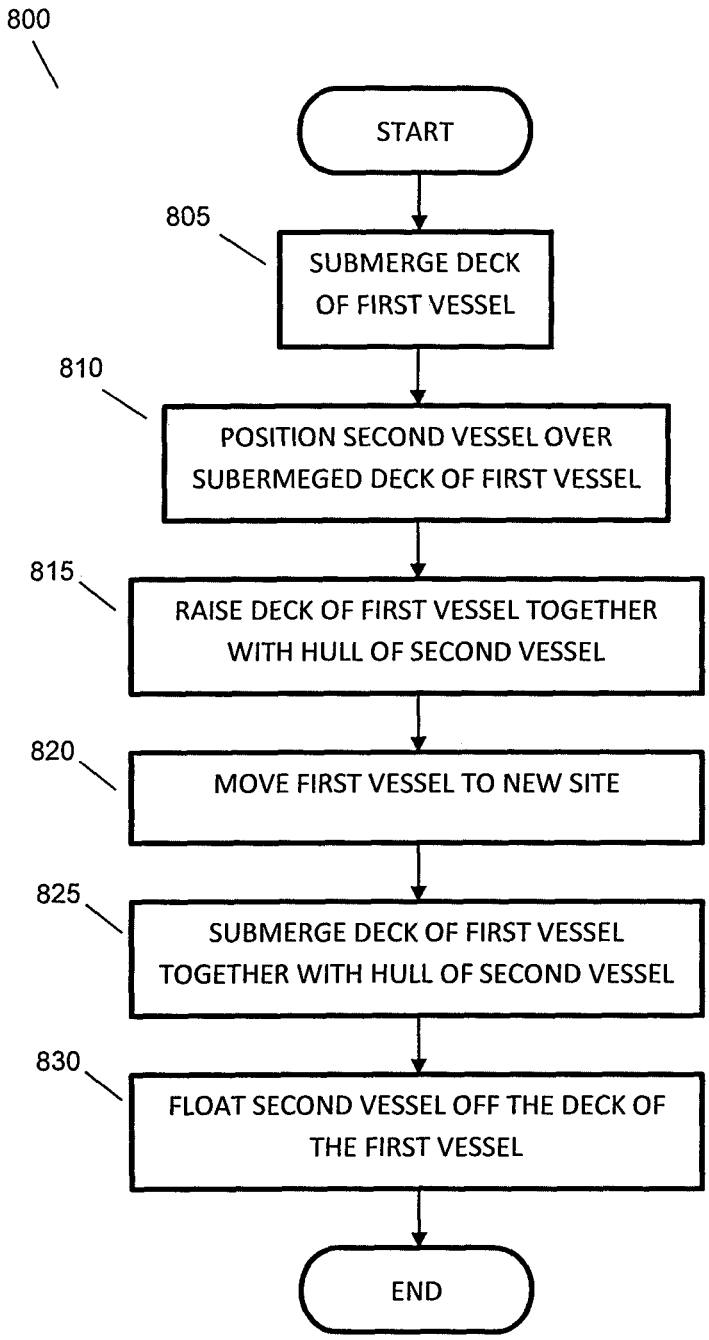
FIG. 8 illustrating a flow chart depicting a method of dry docking a vessel in accordance with embodiments of this invention.

FIG. 8 illustrates process 800 that is performed by a heavy lift and logistics vessel to dry dock a vessel in accordance with embodiments of this invention. Process 800 begins in step 805 by submerging a deck of the heavy lift and logistics vessel below a water level. The vessel which is to be docked on the heavy lift and logistics vessel is then positioned over the submerged docked deck of the heavy lift and logistics vessel in step 810. At step 815, the deck of the heavy lift and logistics vessel is raised above the water level. This causes the hull of the docked vessel to rise as well above the water level. The heavy lift and logistics vessel together with the docked vessel are then transported to a new location or a new site at step 820. Once the heavy lift and logistics vessel arrives at the new site, the deck of the heavy lift and logistics vessel is then submerged below the water level. This occurs at step 825. As the hull of the vessel submerges below the water level, the vessel will float on its accord. At step 830, the floating vessel will then be guided away from the deck of the heavy lift and logistics vessel towards the new site. Process 800 then ends.

An example of a heavy lift and logistics vessel in accordance with embodiments of the invention is set out below.

TABLE 1

| Dimensions | |
|---|---|
| Length | 205 m |
| Beam | 50 m |
| Depth | 15 m |
| Draft | 10 m |
| Average Depth | 22.5 m |
| Displacement | 82769 mt |
| CUNO | 153750 m3 |
| tons/m3 | 0.085 |
| Steel Wt | 19603 mt |
| Lightship (1.25*StWt) | 24504 mt |
| Payload | |
| Rig | 25408 mt |
| Cargo Dwt | 32856 mt |
| Fuel | 20000 mt |
| Well Consumables | 12856 mt |

Table 1 above illustrates the approximate dimensions of a heavy lift and logistics vessel in accordance with an embodiment of this invention.

The above is a description of a heavy lift and logistics vessel for loading, transporting and unloading a vessel. It is foreseen that those skilled in the art can and will design alternative embodiments of this invention as set forth in the following claims.

The invention claimed is:

1. An integrated heavy lift and logistics vessel for docking a vessel comprising:

a deck having a first section for receiving a vessel, and a second section bordered by a first wing-wall provided on a port side of the deck, a second wing-wall provided on a starboard side of the deck, and a deck box provided at a bow of the deck, the deck box abutting the first wing-wall and the second wing-wall wherein the first wing-wall comprises a first tube extending from a hull of the integrated heavy lift and logistics vessel to the deck, the first tube having a first opening at the hull and a second opening at a surface of the first wing-wall facing the deck, wherein in response to the ballasting system lowering the deck below the water level, water flows through the first tube via the first opening and the second opening to flood the second section of the deck and further wherein the first tube is tilted at an angle in relation to a surface of the deck such that the first opening of the tube is positioned lower than the second opening of the first tube;

a ballasting system configured to lower the deck below a water level and below a hull of a docking vessel, and to raise the deck above the water level, wherein the second section of the deck is configured to flood when the deck is lowered below the water level; and an accommodation unit provided on a top surface of the deck box.

2. The integrated heavy lift and logistics vessel of claim 1 wherein the second wing-wall comprises:

a second tube extending from a hull of the integrated heavy lift and logistics vessel to the deck, the second tube having a first opening at the hull and a second opening at a surface of the second wing-wall facing the deck, wherein in response to the ballasting system lowering the deck below the water level, water flows through the first opening and the second opening to flood the second section of the deck.

3. The integrated heavy lift and logistics vessel of claim 1 further comprising:

a helipad provided on a top surface of the accommodation unit.

4. The integrated heavy lift and logistics vessel of claim 1 further comprising:

means for handling discharge of cargo from the integrated heavy lift and logistics vessel to an attending vessel.

5. The integrated heavy lift and logistics vessel of claim 1 further comprising:

an emergency shelter.

6. The integrated heavy lift and logistics vessel of claim 5 wherein the emergency shelter further comprises emergency medical facilities.

7. The integrated heavy lift and logistics vessel of claim 1 further comprising:

storage means provided in a hull of the integrated heavy lift and logistics vessel for storing liquids.

8. The integrated heavy lift and logistics vessel of claim 1 further comprising:

pipe racks provided on the deck box for storing tubular members.

* * * * *